US009099766B2

(12) United States Patent
Chan et al.

(10) Patent No.: US 9,099,766 B2
(45) Date of Patent: Aug. 4, 2015

(54) WIDEBAND ANTENNA STRUCTURE

(71) Applicant: Quanta Computer Inc., Kuei Shan Hsiang, Tao Yuan Shien (TW)

(72) Inventors: Ming-Che Chan, Tao Yuan Shien (TW); Chun-I Lin, Tao Yuan Shien (TW); Hui Lin, Tao Yuan Shien (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days.

(21) Appl. No.: 14/181,014

(22) Filed: Feb. 14, 2014

(65) Prior Publication Data

US 2015/0123874 A1 May 7, 2015

(30) Foreign Application Priority Data

Nov. 4, 2013 (TW) ..... 102139900 A

(51) Int. Cl.
*H01Q 5/00* (2015.01)

(52) U.S. Cl.
CPC ..... *H01Q 5/0093* (2013.01); *H01Q 5/0027* (2013.01)

(58) Field of Classification Search
CPC ..... H01Q 5/0093; H01Q 5/0027
See application file for complete search history.

(56) References Cited

U.S. PATENT DOCUMENTS

| | | | | |
|---|---|---|---|---|
| 8,373,604 | B2 | 2/2013 | Wong et al. | |
| 8,436,774 | B2 | 5/2013 | Wong et al. | |
| 2001/0030627 | A1* | 10/2001 | Andersson | 343/702 |
| 2005/0275595 | A1* | 12/2005 | Endo et al. | 343/702 |
| 2008/0198088 | A1* | 8/2008 | Lin et al. | 343/850 |
| 2011/0095949 | A1* | 4/2011 | Wong et al. | 343/702 |
| 2011/0122027 | A1* | 5/2011 | Wong et al. | 343/700 MS |
| 2013/0162494 | A1 | 6/2013 | Wong et al. | |
| 2013/0307732 | A1* | 11/2013 | Chiu et al. | 343/700 MS |

FOREIGN PATENT DOCUMENTS

| | | |
|---|---|---|
| TW | 201115833 | 5/2011 |
| TW | 201119142 | 6/2011 |
| TW | I366950 | 6/2012 |
| TW | 201328016 | 7/2013 |

OTHER PUBLICATIONS

Taiwanese language office action dated Jun. 27, 2014.
English language translation of abstract of TW 201115833 (published May 1, 2011).
English language translation of abstract of TW 201119142 (published Jun. 1, 2011).
English language translation of abstract of TW I366950 (published Jun. 21, 2011).
English language translation of abstract of TW 201328016 (published Jul. 1, 2013).

* cited by examiner

*Primary Examiner* — Trinh Dinh
(74) *Attorney, Agent, or Firm* — McClure, Qualey & Rodack, LLP

(57) ABSTRACT

An antenna structure includes a ground plane, a feeding element, and a coupling radiation element. The feeding element is coupled to a signal source. The feeding element substantially has a T-shape. The coupling radiation element is separate from the feeding element and is adjacent to the feeding element. The coupling radiation element is further coupled to the ground plane and at least partially surrounds the feeding element.

6 Claims, 4 Drawing Sheets

WIDEBAND ANTENNA STRUCTURE

CROSS REFERENCE TO RELATED APPLICATIONS

This Application claims priority of Taiwan Patent Application No. 102139900 filed on Nov. 4, 2013, the entirety of which is incorporated by reference herein.

BACKGROUND OF THE INVENTION

1. Field of the Invention

The disclosure generally relates to an antenna structure, and more particularly, to a wideband antenna structure for use in a mobile device.

2. Description of the Related Art

With the progress of mobile communication technology, portable devices, such as notebook computers, tablet computers, mobile phones, multimedia players, and other hybrid functional portable devices, have become more common To satisfy the demand of users, portable devices usually can perform wireless communication functions. Some devices cover a large wireless communication area; for example, mobile phones use 2G, 3G, LTE (Long Term Evolution) and 4G systems and use frequency bands of 700 MHz, 850 MHz, 900 MHz, 1800 MHz, 1900 MHz, 2100 MHz, 2300 MHz, and 2500 MHz. Some devices cover a small wireless communication area; for example, mobile phones use Wi-Fi, Bluetooth, and WiMAX (Worldwide Interoperability for Microwave Access) systems and use frequency bands of 2.4 GHz, 3.5 GHz, 5.2 GHz, and 5.8 GHz.

In conventional designs, a fixed-size metal element is often used as a main antenna body in a mobile device, and the length of the metal element should be equal to a half of wavelength ($\lambda/2$) or a quarter of wavelength ($\lambda/4$) which corresponds to the desired frequency band. However, since the metal element for the generation of low-frequency bands requires a longer resonant path, it is difficult to design the metal element in the limited inner space of a mobile device.

BRIEF SUMMARY OF THE INVENTION

To overcome the drawbacks of the prior art, the invention provides a small-size wideband antenna structure, which may be applied to a variety of mobile devices, such as a notebook computer or a tablet computer. In one exemplary embodiment, the disclosure is directed to an antenna structure, including: a ground plane; a feeding element, coupled to a signal source, and substantially having a T-shape; and a coupling radiation element, coupled to the ground plane, and disposed adjacent to the feeding element; in which the coupling radiation element is separate from the feeding element and at least partially surrounds the feeding element.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1:
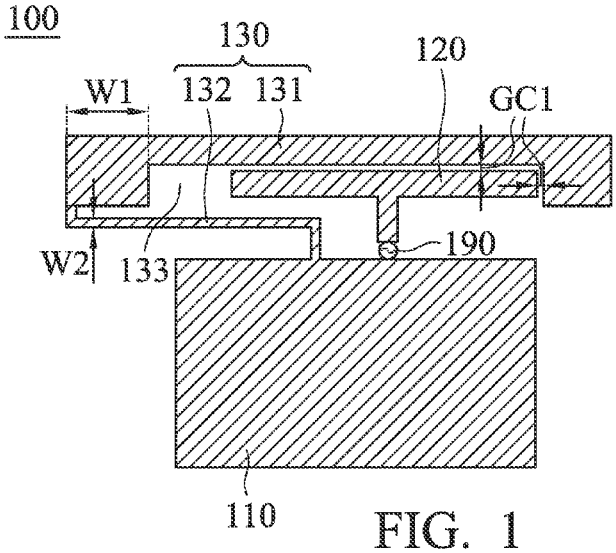
FIG. 1 is a diagram for illustrating an antenna structure according to an embodiment of the invention.

FIG. 1 is a diagram for illustrating an antenna structure 100 according to an embodiment of the invention. The antenna structure 100 may be designed in a mobile device, such as a notebook computer or a tablet computer. As shown in FIG. 1, the antenna structure 100 at least includes a ground plane 110, a feeding element 120, and a coupling radiation element 130. In some embodiments, the ground plane 110, the feeding element 120, and the coupling radiation element 130 are all made of conductive materials, such as copper, silver, iron, aluminum, or their alloys. In some embodiments, the antenna structure 100 is disposed on a dielectric substrate. The ground plane 110 may be coupled to a system ground plane of the mobile device, or may be a portion of the system ground plane. The feeding element 120 substantially has a T-shape. The feeding element 120 is coupled to a signal source 190. The signal source 190 may be an RF (Radio Frequency) module of the mobile device, and may be configured to excite the antenna structure 100. The coupling radiation element 130 is coupled to the ground plane 110. The coupling radiation element 130 is separate from the feeding element 120 and is disposed adjacent to the feeding element 120. To save design space, the coupling radiation element 130 at least partially surrounds the feeding element 120.

More particularly, in some embodiments, the coupling radiation element 130 includes a main portion 131 and a shorting portion 132. The main portion 131 is disposed adjacent to the feeding element 120. The main portion 131 is coupled through the shorting portion 132 to the ground plane 110. In some embodiments, the coupling radiation element 130 has a width-varying structure. For example, the width W2 of the shorting portion 132 is much narrower than the width W1 of the main portion 131. The width-varying structure is configured to adjust the impedance matching of the antenna structure 100. In other embodiments, adjustments are made such that the coupling radiation element 130 has an equal-width structure. A coupling gap GC1 may be formed between the feeding element 120 and the main portion 131 of the coupling radiation element 130, and therefore the feeding energy of the signal source 190 may be transmitted from the feeding element 120 through the coupling gap GC1 to the coupling radiation element 130. To enhance the mutual coupling effect, the width of the coupling gap GC1 should be less than 2 mm, and may be preferably from 0.5 mm to 1 mm. In some embodiments, the main portion 131 of the coupling radiation element 130 substantially has an inverted U-shape. In other words, the main portion 131 of the coupling radiation element 130 has a notch 133, and at least one portion of the feeding element 120 is located in the notch 133. In some embodiments, the notch 133 substantially has a rectangular shape or a rectangular edge. In other embodiments, adjustments are made such that the notch 133 substantially has a semicircular shape or an arc-shaped edge. On the other hand, the shorting portion 132 of the coupling radiation element 130 may have a variety of shapes, such as an N-shape, an L-shape, or an S-shape.

With respect to the antenna theory, a low-frequency resonant path corresponding to a low-frequency band of the antenna structure 100 may be formed by the feeding element 120 and the coupling radiation element 130, and a high-frequency resonant path corresponding to a high-frequency band of the antenna structure 100 may be formed by the feeding element 120. Since the coupling radiation element 130 substantially surrounds the feeding element 120 and is excited by the mutual coupling effect, the low-frequency resonant path may have a shorter length and occupy a smaller area. On the other hand, the feeding element 120 with a T-shape has two branches to generate two resonant modes, and it therefore increases the bandwidth of the high-frequency band. As a result, the antenna structure 100 of the invention has the advantages of small size and wide bandwidth, and it is suitably applied to a variety of small-size mobile devices.

Figure 2:
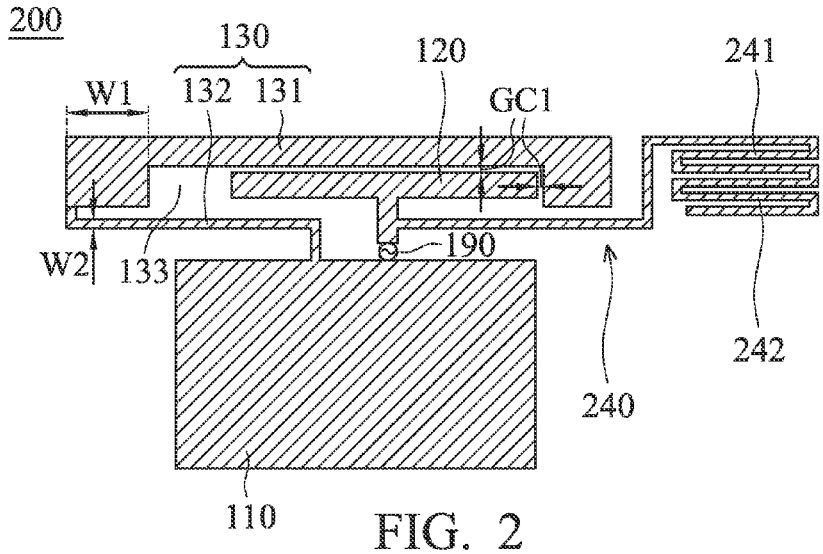
FIG. 2 is a diagram for illustrating an antenna structure according to an embodiment of the invention.

FIG. 2 is a diagram for illustrating an antenna structure 200 according to an embodiment of the invention. FIG. 2 is similar to FIG. 1. The difference between the two embodiments is that the antenna structure 200 of FIG. 2 further includes an extension radiation element 240. The extension radiation element 240 is made of a conductive material, such as copper, silver, iron, aluminum, or their alloys. The extension radiation element 240 is coupled to the feeding element 120. In some embodiments, a connection end of the extension radiation element 240 is adjacent to a feeding end of the feeding element 120. To increase the resonant length and reduce the area, the extension radiation element 240 may have a meander structure. For example, the meander structure may include an inverted S-shaped portion 241 and an S-shaped portion 242 of the extension radiation element 240, and the inverted S-shaped portion 241 and the S-shaped portion 242 are coupled to each other. In some embodiments, the meander structure may have other shapes, such as including one or more W-shaped portions coupled to each other. A low-frequency resonant path corresponding to a low-frequency band of the antenna structure 200 may be formed by the extension radiation element 240. The bandwidth of the low-frequency band may be further increased due to the existence of the extension radiation element 240, the feeding element 120, and the coupling radiation element 130. Other features of the antenna structure 200 of FIG. 2 are similar to those of the antenna structure 100 of FIG. 1. Therefore, the two embodiments can achieve similar levels of performances.

Figure 3:
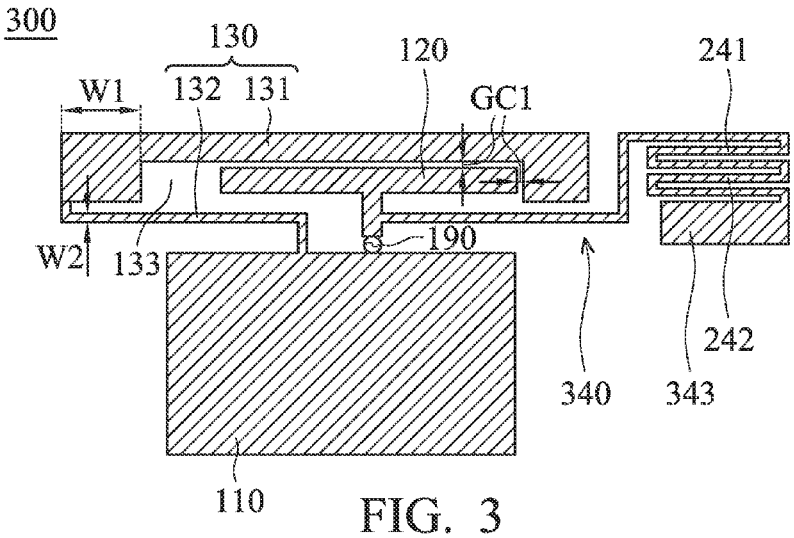
FIG. 3 is a diagram for illustrating an antenna structure according to an embodiment of the invention.

FIG. 3 is a diagram for illustrating an antenna structure 300 according to an embodiment of the invention. FIG. 3 is similar to FIG. 2. The difference between the two embodiments is that an extension radiation element 340 of the antenna structure 300 of FIG. 3 further includes a rectangular widening portion 343. More particularly, a connection end of the extension radiation element 340 is coupled to the feeding element 120 (e.g., the connection end is adjacent to a feeding end of the feeding element 120), and the rectangular widening portion 343 is located at another end (opposite to the connection end) of the extension radiation element 340. The rectangular widening portion 343 of the extension radiation element 340 provides a capacitive load, and the capacitive load is used to adjust the impedance matching of the antenna structure 300 and to further increase the bandwidth of the antenna structure 300. In other embodiments, adjustments are made such that the rectangular widening portion 343 of the extension radiation element 340 substantially has a square shape or a semicircular shape. Other features of the antenna structure 300 of FIG. 3 are similar to those of the antenna structure 200 of FIG. 2. Therefore, the two embodiments can achieve similar levels of performances.

Figure 4:
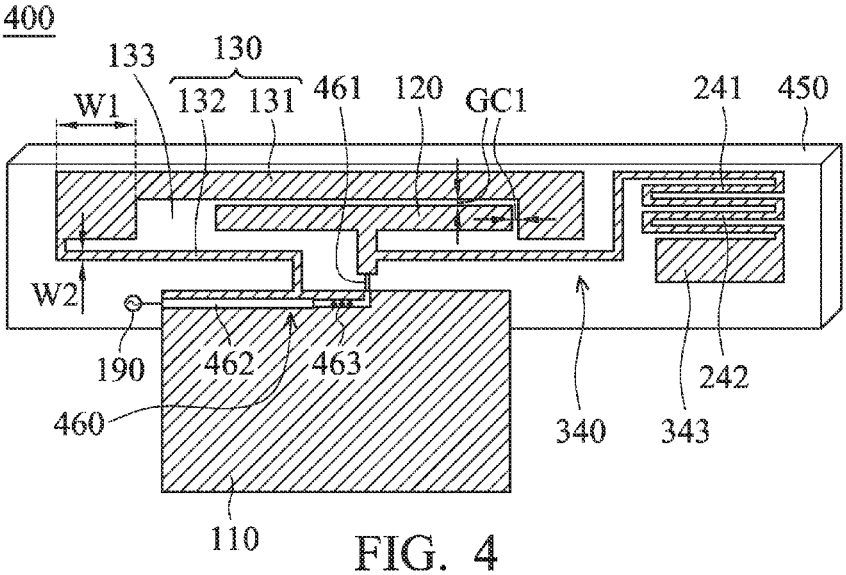
FIG. 4 is a diagram for illustrating an antenna structure according to an embodiment of the invention.

FIG. 4 is a diagram for illustrating an antenna structure 400 according to an embodiment of the invention. FIG. 4 is similar to FIG. 3. The difference between the two embodiments is that the antenna structure 400 of FIG. 4 further includes a dielectric substrate 450 and a coaxial cable 460. The dielectric substrate 450 may be an FR4 (Flame Retardant 4) substrate. As shown in FIG. 4, at least one portion of the ground plane 110, the feeding element 120, the coupling radiation element 130, and the extension radiation element 340 are all disposed on a surface of the dielectric substrate 450. That is, the antenna structure 400 substantially has a planar structure, and therefore it has a very low antenna height. The coaxial cable 460 at least includes a central conductive line 461 and an outer conductive housing 462. The signal source 190 may be coupled through the coaxial cable 460 to the antenna structure 400. For example, a positive electrode of the signal source 190 may be coupled through the central conductive line 461 to a feeding end of the feeding element 120, and a negative electrode of the signal source 190 may be coupled through the outer conductive housing 462 to the ground plane 110. In addition, the coaxial cable 460 may further include a Teflon material 463 disposed between the outer conductive housing 462 and the central conductive line 461, and a plastic rind covering the outer conductive housing 462. Other features of the antenna structure 400 of FIG. 4 are similar to those of the antenna structure 300 of FIG. 3. Therefore, the two embodiments can achieve similar levels of performances.

Figure 5:
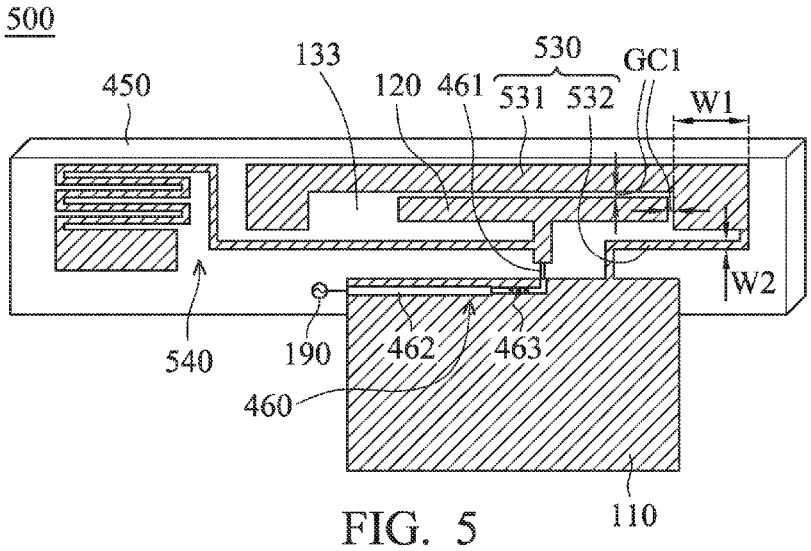
FIG. 5 is a diagram for illustrating an antenna structure according to an embodiment of the invention.

FIG. 5 is a diagram for illustrating an antenna structure 500 according to an embodiment of the invention. FIG. 5 is similar to FIG. 4. The difference between the two embodiments is that, in the antenna structure 500 of FIG. 5, the position of a shorting portion 532 of a coupling radiation element 530 is substantially interchanged with the position of an extension radiation element 540. That is, the coupling radiation element 530 has a grounding path located at a different side of the antenna structure 500, and correspondingly, the extension radiation element 540 has a resonant path located at another different side of the antenna structure 500. The aforementioned interchanged position design does not affect the radiation performance of the antenna structure 500. Other features of the antenna structure 500 of FIG. 5 are similar to those of the antenna structure 400 of FIG. 4. Therefore, the two embodiments can achieve similar levels of performances.

Figure 6:
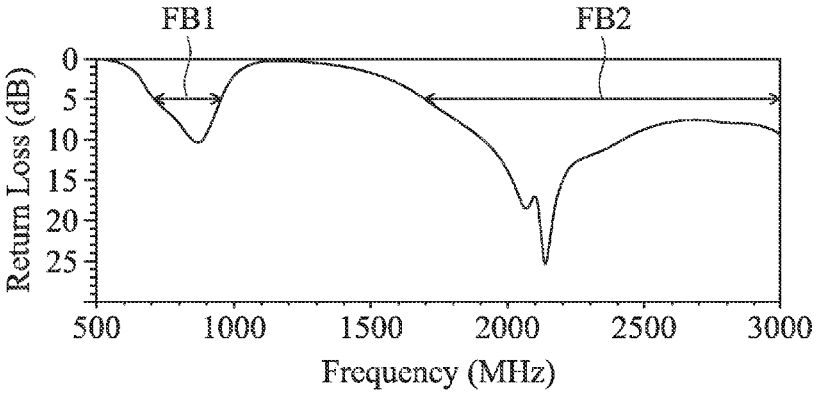
FIG. 6 is a diagram for illustrating return loss of an antenna structure according to an embodiment of the invention.

FIG. 6 is a diagram for illustrating return loss of the antenna structure 400 according to an embodiment of the invention. Please refer to FIG. 4 and FIG. 6 together. In the antenna structure 400, the feeding element 120, the coupling radiation element 130, and the extension radiation element 340 may be excited to generate a low-frequency band FB1; and the feeding element 120 is further excited to generate a high-frequency band FB2. In a preferred embodiment, the low-frequency band FB1 is substantially from 700 MHz to 960 MHz, and the high-frequency band FB2 is substantially from 1710 MHz to 2690 MHz. As a result, the antenna structure of the invention is capable of covering at least LTE700/GSM850/GSM900/DCS1800/PCS1900/UMTS2000/LTE2300/LTE2500 multiple frequency bands. According to a measurement result, the antenna structure has antenna efficiency which is greater than 35% in the above frequency bands, and it can meet the requirements of practical applications. Note that the extension radiation element 340 and the rectangular widening portion 343 are optional in the invention, and in other embodiments, they may be removed from the antenna structure without affecting the radiation performance of the antenna structure.

Please refer to FIG. 4 again. In some embodiments, element sizes of the antenna structure 400 are as follows. The ground plane 110 has a length of about 30 mm, and a width of about 22 mm. The dielectric substrate 450 has a length of about 66 mm, and a width of about 12 mm. The coaxial cable 460 has a length of about 320 mm. The main body of the antenna structure 400 has a total area of about 800 $mm^2$, which meets the criterion of small-size antenna design.

Figure 7:
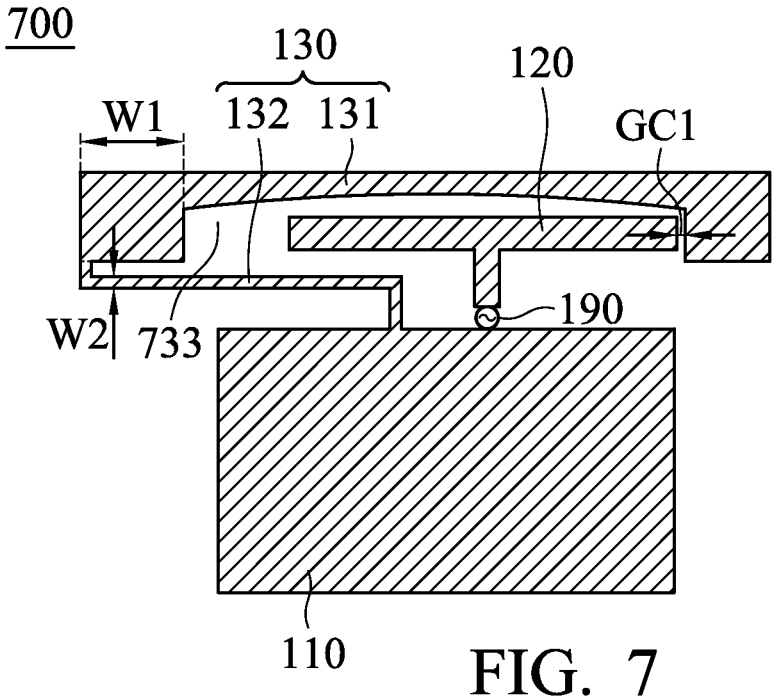
FIG. 7 is a diagram for illustrating an antenna structure according to an embodiment of the invention.

FIG. 7 is a diagram for illustrating an antenna structure 700 according to an embodiment of the invention. FIG. 7 is similar to FIG. 1. The difference between the two embodiments is that the mail portion 131 of the coupling radiation element 130 of FIG. 7 includes an arc-shape edge. As described in connection with FIG. 1, the main portion 131 is coupled through the shorting portion 132 to the ground plane 110. As stated above in connection with the description of FIG. 1, in certain embodiments (such as the embodiment of FIG. 7), the notch 733 substantially has a semicircular shape or an arc-shaped edge. Other features of the antenna structure 700 of FIG. 7 are similar to those of the antenna structure 100 of FIG. 1. Therefore, the two embodiments can achieve similar levels of performances.

Note that the above element parameters, element shapes, and frequency ranges are not limitations of the invention. An antenna engineer can adjust these settings or values according to different requirements. It is understood that the antenna structure of the invention is not limited to the configurations of FIGS. 1-7. The invention may merely include any one or more features of any one or more embodiments of FIGS. 1-7. In other words, not all of the features shown in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. An antenna structure, comprising:

a ground plane;

a feeding element, coupled to a signal source, wherein the feeding element substantially has a T-shape;

a coupling radiation element, coupled to the ground plane, and disposed adjacent to the feeding element, wherein the coupling radiation element is separate from the feeding element and at least partially surrounds the feeding element; and an extension radiation element, coupled to the feeding element, wherein the extension radiation element has a meander structure;

wherein the extension radiation element further comprises a rectangular widening portion, wherein one end of the extension radiation element is coupled to the feeding element, and wherein the rectangular widening portion is located at another end of the extension radiation element;

wherein a width of the rectangular widening portion is much greater than a width of a meander line of the meander structure;

wherein the coupling radiation element comprises a main portion and a shorting portion, and wherein the main portion is disposed adjacent to the feeding element and is coupled through the shorting portion to the ground plane;

wherein the main portion of the coupling radiation element has a notch, and wherein at least one portion of the feeding element is located in the notch;

wherein the notch substantially has a semicircular shape or an arc-shaped edge.

2. The antenna structure as claimed in claim 1, wherein the main portion of the coupling radiation element substantially has an inverted U-shape.

3. The antenna structure as claimed in claim 1, wherein a coupling gap is formed between the feeding element and the main portion of the coupling radiation element, and wherein a width of the coupling gap is less than 2 mm.

4. The antenna structure as claimed in claim 1, wherein the coupling radiation element has a width-varying structure, and wherein a width of the shorting portion is much narrower than a width of the main portion.

5. The antenna structure as claimed in claim 1, further comprising:

a dielectric substrate, wherein at least one portion of the ground plane, the feeding element, the coupling radiation element, and the extension radiation element are all disposed on a surface of the dielectric substrate; and a coaxial cable, comprising a central conductive line and an outer conductive housing, wherein a positive electrode of the signal source is coupled through the central conductive line to the feeding element, and wherein a negative electrode of the signal source is coupled through the outer conductive housing to the ground plane.

6. The antenna structure as claimed in claim 1, wherein the feeding element, the coupling radiation element, and the extension radiation element are excited to generate a low-frequency band, wherein the feeding element is excited to generate a high-frequency band, wherein the low-frequency band is substantially from 700 MHz to 960 MHz, and wherein the high-frequency band is substantially from 1710 MHz to 2690 MHz.

* * * * *